US005248175A

United States Patent [19]

Burns

[11] Patent Number: 5,248,175

[45] Date of Patent: Sep. 28, 1993

[54] PRE-ASSEMBLED HANDLE ATTACHING ARRANGEMENT

[75] Inventor: James A. Burns, Orion, Mich.

[73] Assignee: Chrysler Corporation, Highland Park, Mich.

[21] Appl. No.: 991,429

[22] Filed: Dec. 21, 1992

[51] Int. Cl.[5] ..... A47G 27/04

[52] U.S. Cl. ..... 292/347; 292/DIG. 31

[58] Field of Search ..... 292/337, 347, 256, DIG. 31, 292/113, 247

[56] References Cited

U.S. PATENT DOCUMENTS

| | | | |
|---|---|---|---|
| 2,790,181 | 4/1957 | McCarthy | 292/256 X |
| 3,153,552 | 10/1964 | Sandor | 292/336.3 |
| 3,967,844 | 7/1976 | Torii et al. | 292/336.3 |
| 4,038,718 | 8/1977 | Reilhac et al. | 292/DIG. 31 X |
| 4,475,415 | 1/1982 | Yamamoto | 74/543 |
| 4,588,219 | 5/1986 | Kobayashi et al. | 292/336.3 |
| 4,778,207 | 10/1988 | Gergoe | 292/336.3 |
| 4,838,054 | 6/1989 | Weinerman et al. | 292/DIG. 31 X |
| 4,892,342 | 1/1990 | Newman et al. | 292/347 |
| 4,924,582 | 5/1990 | Keller | 29/434 |

*Primary Examiner*—Richard E. Moore

*Attorney, Agent, or Firm*—Edward P. Barthel

[57] ABSTRACT

A handle assembly, having a release handle mounted flush with a housing, is adapted for installation in a panel aperature from the outboard side of the panel. The housing is formed with a terminal flange provided with an upper omitted segment extending between a pair of handle pivot brackets. A retaining rib extends between the brackets and is offset inboard from the plane of the terminal flange backside. The handle is thus adapted to be mounted in the aperture in a rock-in manner with the terminal flange overlying the panel outer surface while the rib has an offset face abutting the panel inner surface. The housing has an inboard projecting stem supporting a one-piece retainer clip member enabling a single nut, upon being torqued down on the stem, to lock the handle assembly in the panel opening.

11 Claims, 5 Drawing Sheets

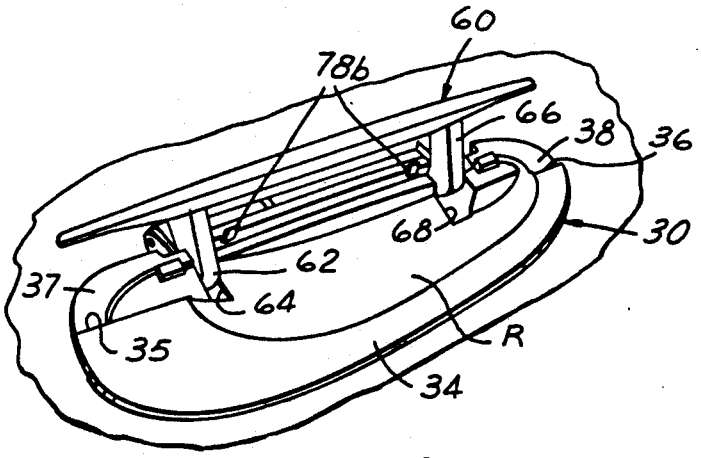
FIG. 1B
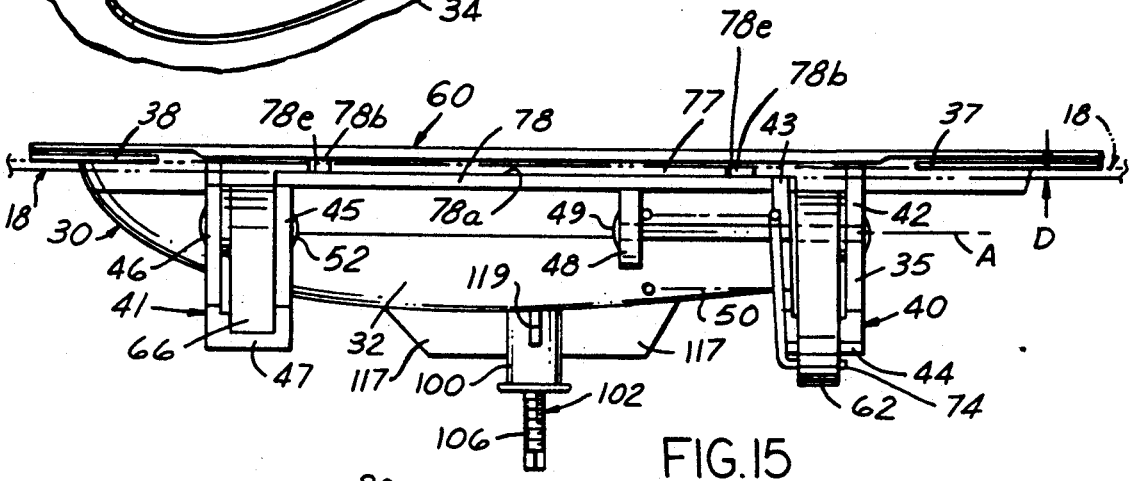
FIG. 15
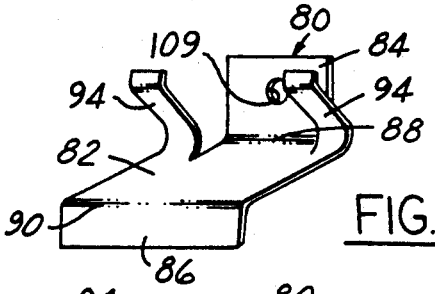
FIG. 16
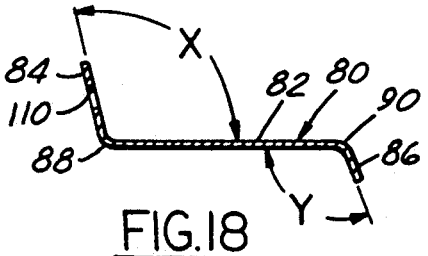
FIG. 18
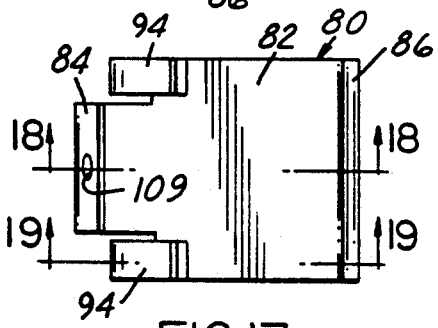
FIG. 17
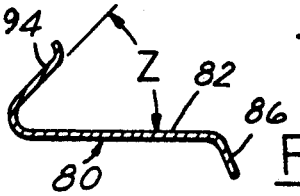
FIG. 19
FIG. 20
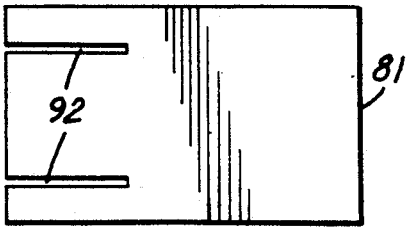

PRE-ASSEMBLED HANDLE ATTACHING ARRANGEMENT

BACKGROUND OF THE INVENTION

This invention relates generally to handle assemblies for motor vehicles and more particularly to a pre-assembled arrangement for attaching a flush-type outside handle assembly to an exterior body panel for actuating a door latch mechanism or the like.

One example of a prior art outside handle assembly mounting arrangement presently used on Chrysler Corporation vehicles is shown in the U.S. Pat. No. 4,892,342 issued to Newman et al. on Jan. 9, 1990. Vehicle handles, such as the Newman et al. door handle for example, are received at the vehicle assembly plant separate from the attaching brackets and fastener end item parts required to mount the handle to the body panel. This requires a substantial number of end item parts be handled separately from the handle together with several manual operations needed to attach the handle to the door panel using the brackets and fastener parts.

SUMMARY OF THE INVENTION

Accordingly, it is a feature of the present invention to provide a handle assembly incorporating a clip member arrangement for securing the handle housing in a motor vehicle panel aperture by means of a single clip, pre-attached to the housing prior to shipment to an assembly plant, thereby reducing part complexity and labor.

It is another feature of the present invention to provide a vehicle handle assembly which enables an installer to mount the assembly in a panel aperture from the exterior of the panel in an interlocked manner whereby tightening a nut from the panel interior on a housing threaded stem moves a pre-attached retaining clip from a first pre-attached position to a second installed position thereby fixedly retaining the handle assembly in the aperture.

It is still another feature of the present invention to provide a handle assembly as set forth above wherein the assembly is initially inserted in the panel aperture in a tilted manner from the exterior of the panel enabling housing notch means to engage an upper edge of the aperture established a swingline pivot whereby rocking the housing downwardly along the swingline seats both the housing terminal flange on the panel exterior and a housing rib offset face on the panel interior prior to the clip being moved between its first and second positions.

It is an additional feature of the present invention to provide a handle assembly as set forth above wherein the retaining clip is configured in a double-L shaped section comprising a body panel formed with an upstanding apertured head panel at one inboard transverse bend juncture and a depending foot panel at a second outboard transverse bend juncture.

The handle assembly comprises a housing formed with a central body having an inwardly depressed recess for receiving a release handle therein. A pair of longitudinally spaced upright brackets are integrally formed on the housing body supporting the handle for movement from its normal flush position to an upwardly rotated release position. A terminal flange surrounds the housing body with an upper portion having an omitted segment co-extensive with the space between its pair of upstanding handle support brackets. The housing terminal flange upper omitted segment is at least co-extensive with an elongated retaining rib extending longitudinally between the pair of brackets. The retaining rib has a face offset from a plane that includes the backside of the housing terminal flange providing mating support with the panel inner surface. Once the handle is initially in place, a nut is driven from the inboard side of the panel tightening the nut against the head panel of a pre-attached one-piece clip. The clip is bent in a double-L cross sectional shape providing a base panel having an upstanding head panel at one inboard end and a depending foot panel at its outboard end. As a result, the clip is moved on a housing threaded stem in a compound manner from a first pre-attached position to a second installed position. The clip outboard end is supported on a housing ramp sloped in an oblique plane whereby tightening the nut results in rotational and axial movement of the clip head panel causing the clip foot panel to advance along the oblique plane to its housing installed second position. In its second position, the clip foot panel extends a predetermined dimension below the lower edge of the housing terminal flange, contacting with both the housing and the interior surface of the aperture flanged border, thereby positively securing the handle assembly.

BRIEF DESCRIPTION OF THE DRAWINGS

Other features and advantages of the invention, such as improved appearance and service disassembly, will be evident from the following detailed description of the preferred embodiment of the invention and the accompanying drawings wherein:

FIG. 1B is a view similar to FIG. 1 showing the handle assembly with its release handle shown in its raised or pull-up door unlatched position for door opening movement;

FIG. 15 is a top view of the handle assembly received in the panel aperture with the retaining clip member removed;

FIG. 16 is a detail perspective view of the retaining clip member of the present invention;

FIG. 17 is a top plan view of the retaining clip member of FIG. 16;

FIG. 18 is a vertical sectional view taken on the line 18—18 of FIG. 17;

FIG. 19 is a vertical sectional view taken on the line 19—19 of FIG. 17;

FIG. 20 is a plane view of the sheet metal blank from which the retaining clip member shown in FIGS. 1-19 is formed;

DETAILED DESCRIPTION OF THE INVENTION

Figure 1A:
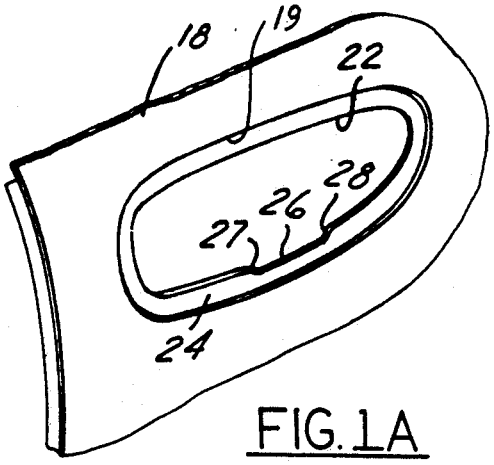
FIG. 1A is a fragmentary perspective detail view of the door panel of FIG. 1 showing an elongated aperture therein adapted to receive the door handle assembly of the present invention.
Figure 1:
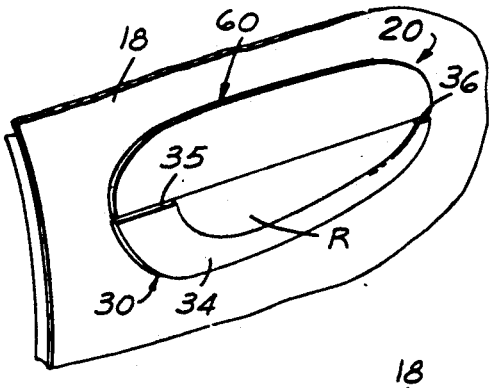
FIG. 1 is a fragmentary perspective view of a door handle assembly mounted in an exterior door panel aperture in a flush door closed position.

Referring now to the drawings and more particularly to FIG. 1 wherein a portion of an automobile body panel, partially indicated at 18, has an outboard or exterior surface and an inboard or interior surface. The panel 18, which in the disclosed embodiment is a vehicle door panel, includes a flush type outside door handle assembly 20 for operating a conventional door latch (not shown). The door panel 18 is shown in FIG. 1A formed with a generally oval-shaped handle aperture 22 configured to accommodate the handle housing assembly 20. The panel aperture 22 is defined by a countersunk continuous flanged border 24 recessed inboard in a manner conforming to the contour of the apertured panel 18. The flanged border 24 has its lower portion formed with an elongated central cutout 26 defined by longitudinally spaced fore and aft lead-in beveled slopes 27 and 28, respectively. The panel aperture 22 is adapted to receive the handle assembly 20 from the outboard side of the panel 18 rocked-in about a predetermined swingline established by an installation pivot described below.

With reference to FIGS. 1 and 1B, the handle assembly 20 includes a housing 30, preferably of molded plastic, having an inboard depressed central body portion 32 defining an outboard facing generally oval-shaped central recess R (FIG. 1). The recess is sized for inserting the operator's fingers behind a release handle pivotally mounted on the housing for location between an extended operable position and a retracted inoperable position within the recess. FIGS. 1 and 9-11 show the housing member central recess R having an outwardly extending integral continuous upwardly opening C-shaped perimeter flange portion 34 extending around the periphery of the body portion 32 except for an upper segment to be described. The housing terminal flange 34 seats on the exterior surface of on the complementary flanged border 24 around the periphery of panel aperture 22. As seen best in FIG. 1B, the C-shaped terminal flange portion 34 comprises a crescent shaped lower half sector terminating at fore and aft horizontally disposed contour lines 35 and 36, respectively, partially defining a pair of substantially mirror image upper arcuate handle flush mounting end sector depressions 37 and 38.

Figure 3:
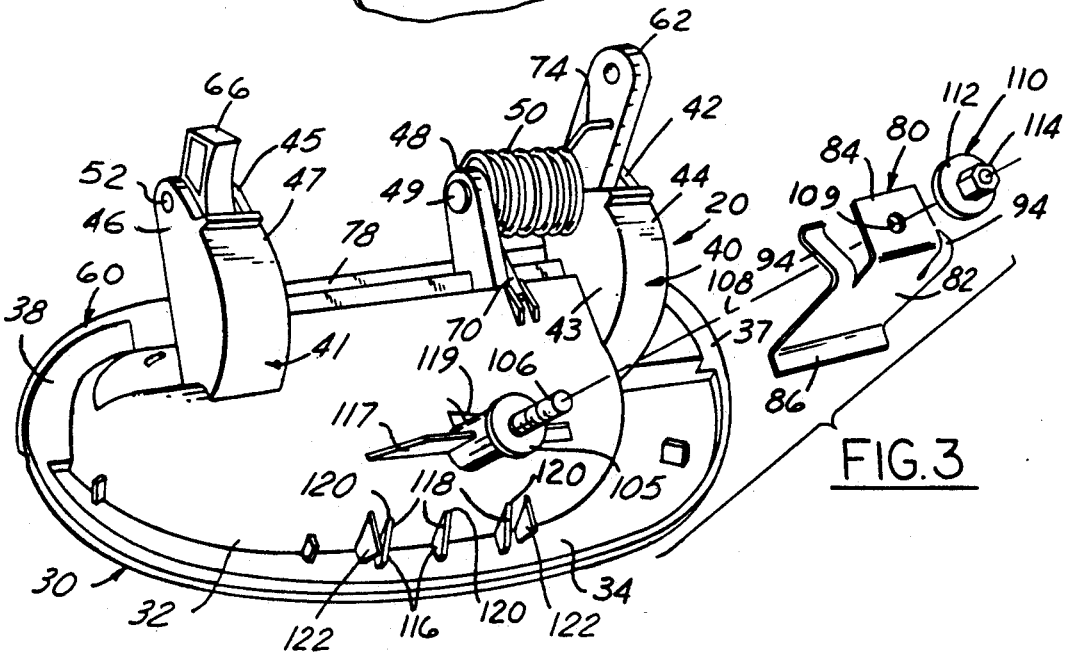
FIG. 3 is an exploded perspective view of the inboard side of the door handle assembly.
Figure 4:
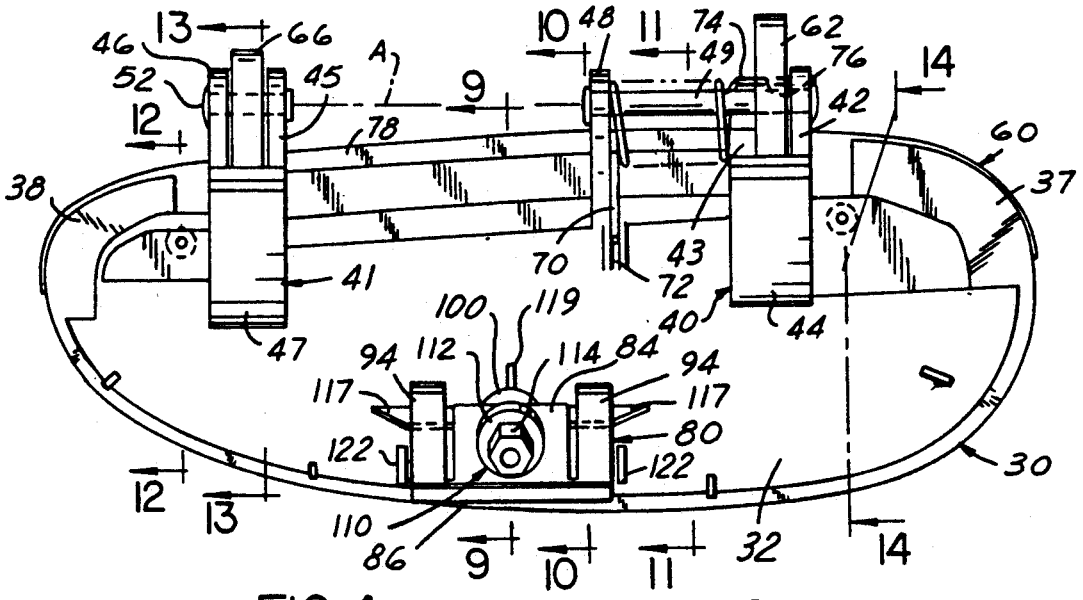
FIG. 4 is a rear side plan view of the door handle assembly of the present invention.

With reference to FIGS. 3 and 4, the housing 30 is preferably molded from a polymeric or plastic glass filled material with the depressed body portion 32 integrally formed with forward or first 40 and aft or second 41 longitudinally spaced box or shroud-like upstanding handle pivot brackets. The forward handle pivot bracket 40 comprises spaced parallel support walls 42, 43 and a bight wall 44 while the aft handle pivot bracket 41 comprises spaced parallel support walls 45, 46 and a bight wall 47. The extension of support wall 42 provides a bore which, together with an intermediate support wall 48 aligned bore, journally receives a first or forward pivot pin 49 surrounded by a return compression coil spring 50. The spring 50 one end abuts the intermediate support wall 48 and the forward pivot pin 49 is aligned on release handle pivot axis "A", as seen in FIG. 4. A second or aft pivot pin 52 is journaled on the pivot axis "A" by means of a pair of aligned bores provided in the respective extensions of support walls 45 and 46.

It will be noted that an integral cylindrical shaped hollow socket portion may be formed adjacent the aft end the housing body portion 32 for the reception of a conventional lock cylinder as shown in the handle of the above mentioned Newman U.S. Pat. No. 4,892,342 for example. However, a vehicle outside door handle assembly for the rear doors of a four-door sedan model, such as the handle assembly 20, requires no lock cylinder and accordingly is omitted from the description.

Figure 2:
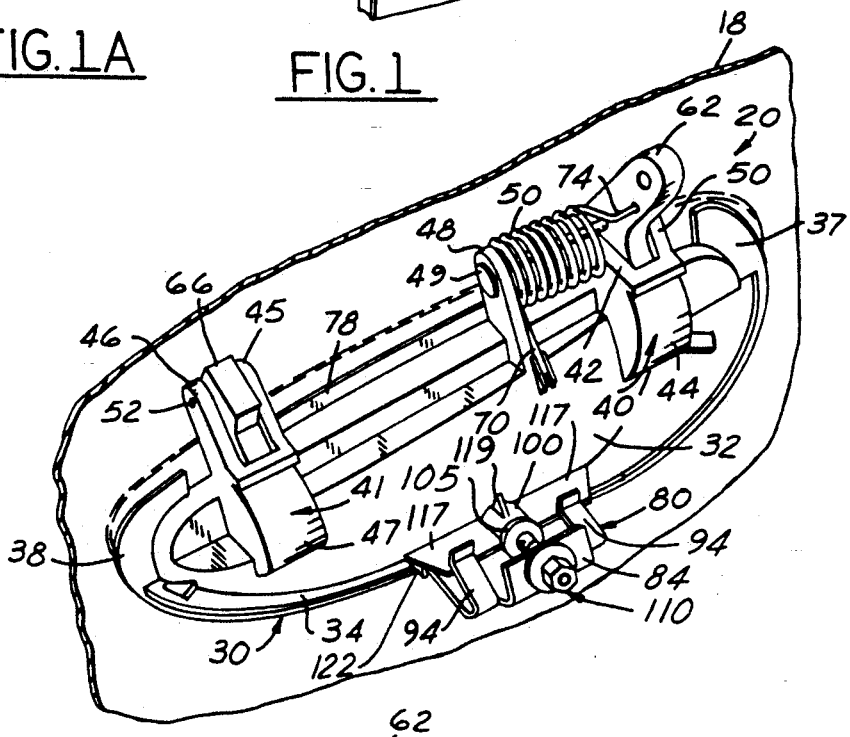
FIG. 2 is a fragmentary perspective view of the inner surface of the door panel of FIG. 1 showing the handle assembly mounted thereon prior to tightening of the threaded fastener.
Figure 13:
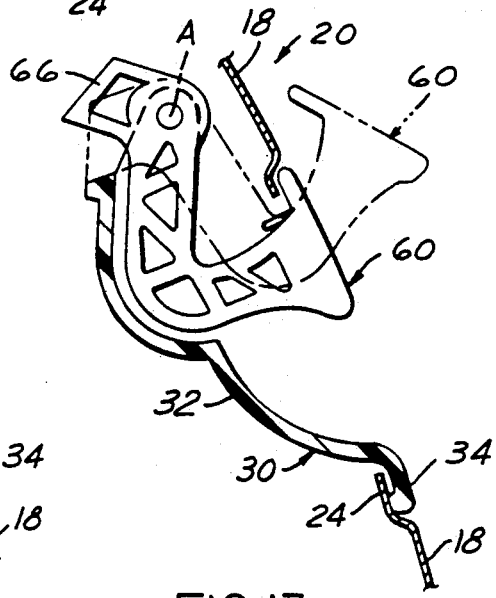
FIG. 13 is a fragmentary vertical sectional view taken substantially along the line 13—13 of FIG. 4.
Figure 14:
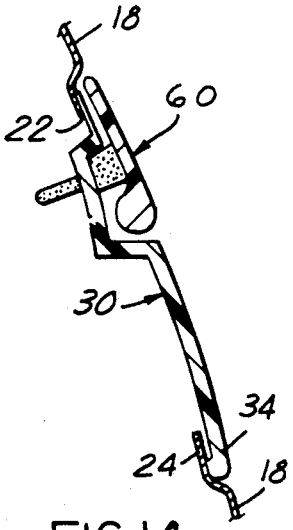
FIG. 14 is a fragmentary vertical sectional view taken substantially along the line 14—14 of FIG. 4.

In FIGS. 1-3, a flush-type release handle 60, also formed of molded plastic, is shown normally pivotally received in its retracted inoperable position in housing recess "R". The release handle 60 is depicted in FIG. 13 adapted to be pivoted about axis "A" in a counter clockwise direction from its normal full line retracted position, flush with the outer surface of the door panel 18, to its phantom line extended operable position wherein it is grasped by the operator and rotated outwardly. The handle 60 is rotated against the force of the coil spring 50 which normally biases the handle in its retracted position in the recess "R".

The handle 60 is integrally formed with a first crankarm lever 62 shown in FIG. 1B projecting through slot 64 in the housing body portion 32. The slot 64 is aligned with an associated passageway formed between the first bracket pair of support walls 42 and 43 for receiving the first lever arm 62 therein. Similarly, a release handle second crankarm lever 66 is adapted to project through aft slot 68 in the body portion 32 aligned with an associated passageway formed between the second bracket pair of support walls 45 and 46.

In FIG. 4, it will be seen that the coil spring 50 one end radial length 70 captured in a groove 72 formed in the housing body and its other end axial length 74 retained in a hole 76 formed in the first lever arm 62. The spring biases the release handle 60 toward its normal fully-closed position of FIG. 13 wherein the handle covers the upper portion of the recess "R". The coils of spring 50 are in pressure contact with the pivot pin 49 so as to transfer the springs' reaction force to the pivot pin.

As seen in FIG. 15, the upper portion of the housing body is formed with an elongated setback clearance 77 co-extensive with a generally rectangular sectioned elongated retaining rib 78. The retaining rib 78 extends longitudinally between the first and second bracket opposing support walls 43 and 45, respectively. It will be noted in FIG. 15 that the rib 78 has an outboard facing riser face 78*a* setback inboard a predetermined dimension "D" from a plane defined by the backside of the terminal flange 34 including the recessed terminal flange end sectors 37 and 38. The setback dimension "D" is slightly less than the clearance 77; i.e., slightly greater than the thickness of the panel 18, for a reason to be explained.

Figure 10:
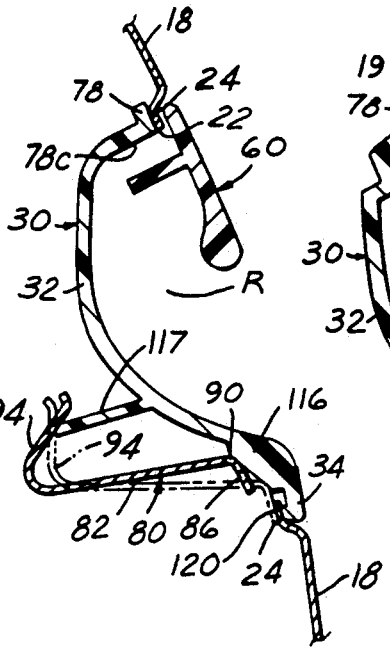
FIG. 10 is a fragmentary vertical sectional view taken substantially along the line 10—10 of FIG. 4.
Figure 11:
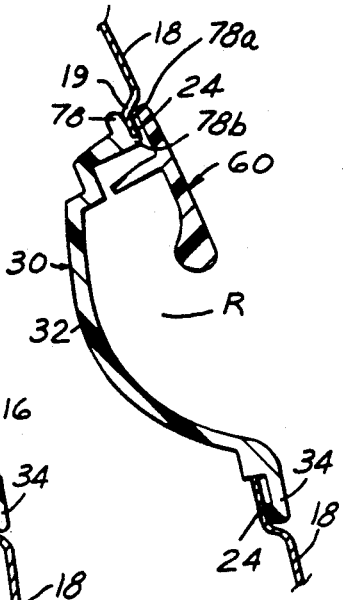
FIG. 11 is a fragmentary vertical sectional view taken substantially along the line 11—11 of FIG. 4.

With reference to FIGS. 1B, 11 and 15, it will be seen that the rib 78 is provided with a plurality of longitudinally spaced protruding tabs 78*b* extending outboard from undersurface 78*c* (FIG. 10) of the rib. As best seen in FIG. 11, each of the tabs 78*b* define, with an associated portion of the setback face 78*a*, a pair of generally right-angled installation pivot notches 78*e*.

Figure 9:
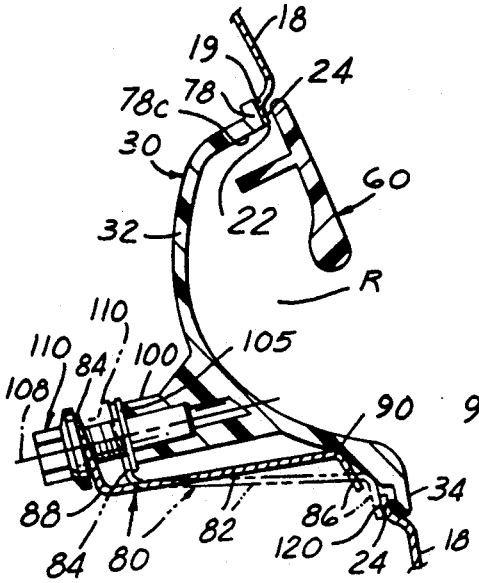
FIG. 9 is a fragmentary vertical sectional view taken substantially along the line 9—9 of FIG. 4.
Figure 21:
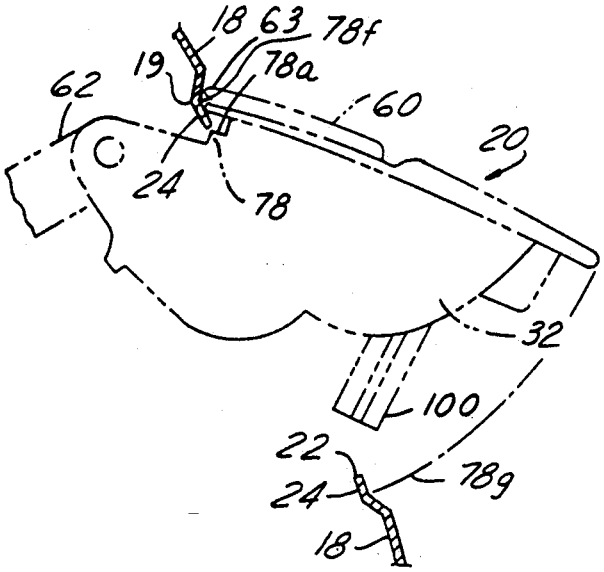
FIG. 21 is a schematic side view for illustrating an initial installation sequence of the handle housing assembly.
Figure 22:
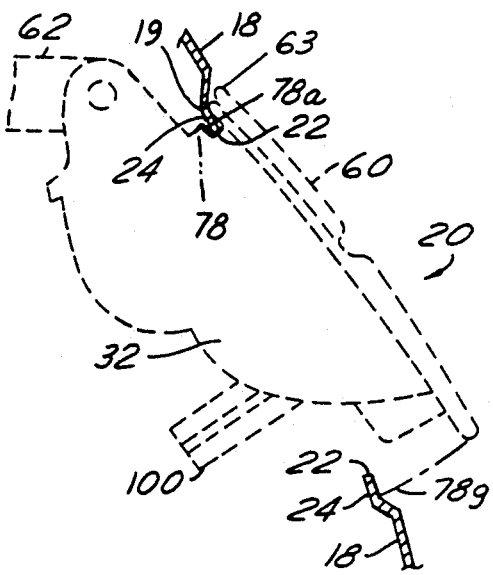
FIG. 22 is a schematic side view similar to FIG. 21 showing a second rocked installation sequence of the handle assembly.

Thus, with reference to the installation schematic of FIG. 21, the handle assembly 20 is shown being installed from the outboard side of the panel 18 by first tilting the handle assembly toward the horizontal such that the upstanding brackets and their associated crankarms 62 lead the assembly into the panel aperture 22. Upon the release handle upper edge 63 engaging an elongated hollow juncture 78*f*, defined by the recessed flanged border 19, the installer starts rotating the handle assembly in a clockwise direction. FIG. 22 shows the handle assembly rocked to an intermediate position wherein the aperture free upper edge 22 engages the installation pivot notches 78*e*. The notches 78*e* establish a defined installation axis enabling the installer to continue rocking the handle assembly along swingline 78*g* to its installed position wherein the terminal flange backside seats on the flanged border 24, as shown in FIGS. 9–11.

As viewed in FIGS. 3 and 16, the handle assembly mounting arrangement further comprises a one-piece spring sheet metal clip, generally indicated at 80. The clip 80 is initially in the form of a stamped lanced flat blank 81, shown in FIG. 20. The blank 81 is subsequently formed, such as by suitable stamping machine dies (not shown), to the clip of FIGS. 16–19.

The clip 80, as seen in FIG. 18, is formed in a generally double-L cross sectional shape comprising a planar body panel 82 bent to define an upstanding head panel 84 at one end and a depending foot panel 86 at the opposite end. The head and foot panels are arranged to extend in opposite directions with the body panel 82 positioned in a generally horizontal manner on the handle housing, as seen in FIG. 9. The head panel 84 is integrally joined to the body panel 82 by a transversely extending bend juncture 88 while the foot panel 86 is integrally joined to the body panel 82 by a transversely extending bend juncture 90 parallel to the bend juncture 88.

As seen in FIG. 18, the retainer clip head panel 84 defines a first included obtuse angle "X" with the base panel 82 of the order of 104 degrees while the clip foot panel 86 defines a second included obtuse angle "Y" with the base plate 82 of the order of 110 degrees. As seen in FIGS. 20, the clip blank 81 is lanced at parallel cut lines defining open ended slots 92 to form a pair of mirror image holding fingers 94 for a purpose to be explained. The fingers 94 are shown in FIG. 19, bent at an acute angle "Z" from the plane of the base plate 82 at an acute angle of the order of 45 degrees. It will be noted that the head panel 84 has a width which is a predetermined dimension less than the width of the base panel 82 to allow for the pair of fingers 94.

Figure 5:
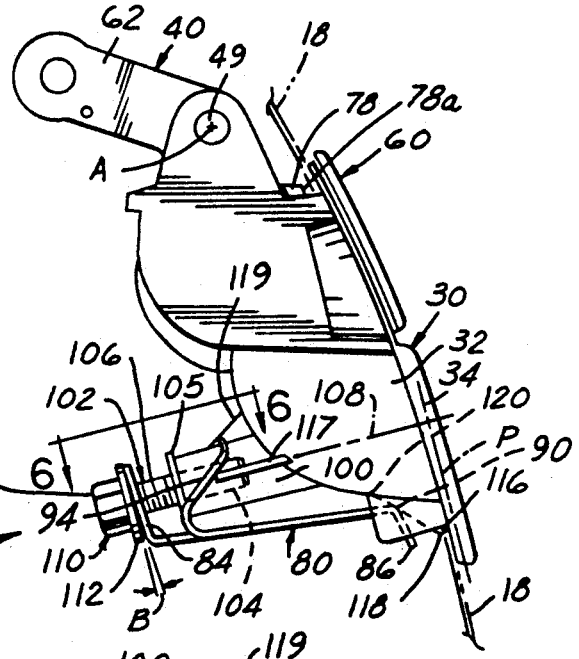
FIG. 5 is a plan view looking at the right hand end of the door handle assembly of FIG. 4.

With reference to FIGS. 3 and 5, the housing central body 32 is integrally joined with one end of an elongated stem portion 100 with the stem free end provided with an axial bore 101 (FIG. 6) fixedly receiving therein a fastening shaft generally indicated at 102. As seen in FIG. 5, the shaft 102 has one anchor end 104 thereof fixedly inserted in the stem portion axial bore and its other end in the form of an integral collar 105 and a threaded shank portion 106. As viewed in FIG. 5, the shank 106 projects inboard with its principal axis 108 oriented substantially normal to an imaginary plane "P" that includes the housing terminal flange portion 34.

Figure 6:
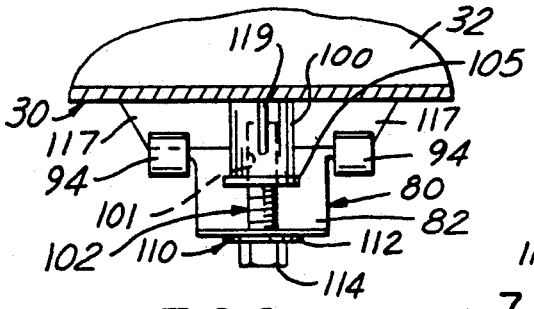
FIG. 6 is a fragmentary top elevation view of FIG. 4 showing the attaching clip mounting arrangement.

As depicted in FIG. 3, the retainer head panel 84 has a central hole 109 therein adapted to receive the threaded shank 106 therethrough for suitable retention thereon in a pre-installed mode. The clip 80 is retained on the shank 106 by fastener means such as a capnut, indicated generally at 110. As seen in FIG. 6, the capnut comprises a washer-like collar portion 112 integrally formed on a hex nut portion 114. Upon the capnut 110 being partially threaded on the shank 106, an upper edge of the collar portion 112 bears on an upper opposed surface of the clip head panel 84.

It will be noted in FIG. 5 that, in its pre-assembled mode, the capnut collar 112 defines an acute angle "B" with the head panel 84 of the order of five degrees. Further, FIG. 5 shows the foot panel bend juncture 89 held in contact with housing ramp means in the form of a plurality of vertically disposed triangular shaped fillets 116. FIG. 3 illustrates the fillets 116 integrally formed at the juncture of the housing central body portion 32 with a lower portion of the terminal flange 34.

Figure 8:
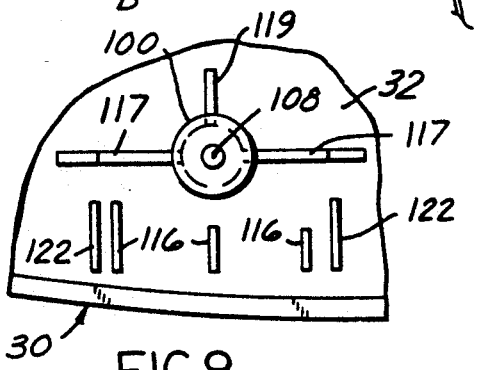
FIG. 8 is a view similar to FIG. 7 with the attaching clip removed.
Figure 9A:
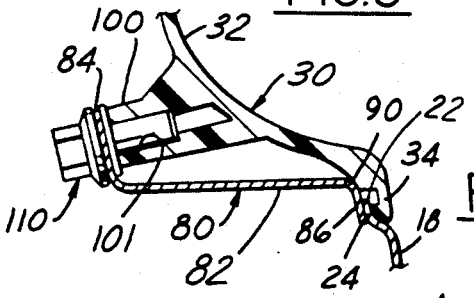
FIG. 9A is a fragmentary vertical sectional view similar to FIG. 9 showing the attachment clip and threaded fastener in their installed torqued-down positions.
Figure 11A:
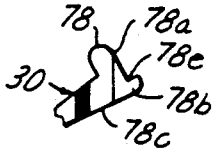
FIG. 11A is an enlarged fragmentary detail view of the housing portion included in the dashed circle denoted "FIG. 11A" in FIG. 11.
Figure 12:
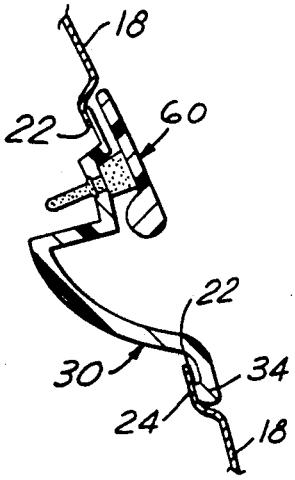
FIG. 12 is a fragmentary vertical sectional view taken substantially along the line 12—12 of FIG. 4.

With reference to FIG. 6, the clip member flexible holding fingers 94 are shown in their clip pre-assembled mode by being resiliently biased into gripping contact with an associated opposed inboard edge of one of a pair of horizontally disposed mirror image gusset plates 117. FIG. 8 shows the gusset plates extending in a coplaner manner from either side of the housing stem 100. The pair of clip fingers 94 function to maintain the clip foot panel 86 in its pre-assembled FIG. 5 location by resiliently biasing the clip bend juncture 90 into contact with fillet ramp edges 118 prior to tightening the capnut 110 on threaded shank 106 to its FIG. 9A position.

Figure 7:
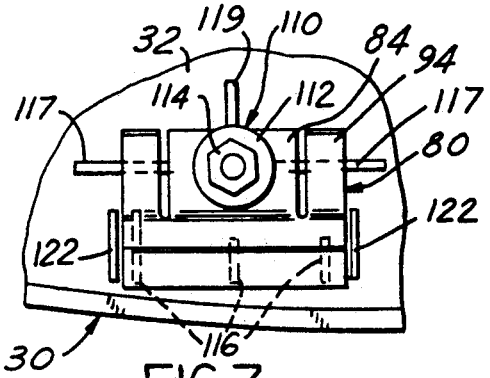
FIG. 7 is a fragmentary rear side plan view taken in the direction of arrow "7" in FIG. 5.

FIG. 3 depicts three triangular ramp fillets 116 each having an angled ramp edge 118 located in a common plane. As viewed in FIG. 5, in the clip pre-attached mode, the foot flange bend line 90 contacts each of the three fillet ramp edges 118 adjacent their upper juncture 120 with the housing body portion 32. It will be seen in FIG. 7 that a pair of vertically disposed end guide fillets 122 are provided on either side of the intermediate ramp fillets 116 and are longitudinally spaced a predetermined dimension slightly greater than the width "W" of the retainer clip 80. The end guide fillets 122 function to accurately position and align the retaining clip foot flange 86 on the three fillet ramps 118 prior to tightening the capnut 110 to its pre-installed mode of FIG. 5.

The door handle assembly 20 is installed from the outboard side of the door panel 18 through the substantially oval-shaped panel aperture 22 by canting or tilting the handle such that the upper pivot brackets 40 and 41 and their respective crankarm members 62 and 66 initially pass therethrough. Thereafter, the upper central portion of the aperture flanged border 24 is received into the elongated clearance 77 until the aperture edge 22 engages the notch junctures 78*e* as seen in FIG. 22. The installer next rocks the housing downwardly about swingline 78*g* into the panel aperture 22 whereby the retaining rib offset face 78*a* seats on an opposed portion of the interior surface of the panel 18 while the backside of the terminal flange seats on a portion of the panel exterior surface. It will be appreciated that in the preferred embodiment the panel portions, seating the housing rib and terminal flange, are interior and exterior portions of the flanged border 24, respectively.

The installation of the handle member 30 is completed by securing the lower central portion of the terminal flange 34 to the panel aperture flanged border 21 by means of the retaining clip 80. This is accomplished by driving the retaining capnut 110 from the interior side of the panel 18. Tightening the capnut 110 from its pre-attached initial torqued position of FIG. 5 to its final torqued opsition of FIG. 9 imparts a combined outward and downward movement to the clip as a result of the foot flange bend juncture 90 sliding on the fillet ramp edges 118 from its pre-attached first position to its second installed position. It will be noted that the clip head panel 84 is moved axially and pivotally along the threaded stem axis 108 from its initial inboard angled position (angle "B" of FIG. 5) to its installed dashed line position of FIG. 9 wherein the head flange 84 is urged into clamped flush relation with the stem collar 105.

While there is described above the principles of this invention in connection with a specific embodiment, it is to be clearly understood that this description is made only by way of example and not as a limitation to the scope of this invention.

I claim:

1. In a handle assembly adapted for mounting in an aperture formed in a vehicle panel having exterior and interior surfaces, said assembly having a housing formed with a terminal flange surrounding a central body portion, said terminal flange having a backside thereof adapted for seating on the panel exterior, said housing provided with handle support bracket means, an arrangement for mounting said handle assembly in the aperture comprising:

a housing having an elongated retaining rib extending generally longitudinally along an upper portion thereof, said rib provided with a face offset inboard a predetermined dimension from an exterior panel surface adapted to seat said housing terminal flange, said housing having notch means formed thereon;

said housing terminal flange formed with an upper elongated omitted segment, said handle in its non-use state having an inboard surface juxtaposed an outboard face of said terminal flange so as to bridge said omitted segment thereby defining an elongated clearance intermediate said rib offset face and said handle inboard surface;

whereby said handle assembly is installed from the panel exterior by tilting said housing such that said bracket means are initially inserted through said aperture locating an upper edge of said aperture in said clearance so as to engage said notch means, whereby an installation axis is established about which said housing is rocked into said aperture about a predetermined swingline until its terminal flange seats on a portion of said panel exterior surface with said rib offset face abutting an opposed interior surface portion of said panel;

said housing body portion formed with support means providing a threaded shank supporting a clip thereon between a first pre-installed position and a second installed position;

said clip formed with a predetermined configuration such that tightening a nut on said threaded shank moves said clip between said first and second positions thereby securing said handle assembly on said panel.

2. The handle mounting arrangement as set forth in claim 1 wherein said support means including ramp means maintaining said clip in said first position, clip comprising an upstanding head panel and a depending foot panel, said head panel formed with a hole receiving said threaded shank therethrough, said nut having an initially tightened pre-installed state bearing on said head panel maintaining said clip on said ramp means, said ramp means defining a predetermined slope angle and said clip being so configured such that further tightening of said nut causes said clip to move on said ramp means to said second installed position wherein said foot panel is urged against a lower portion of said housing terminal flange bears and an opposed portion of said panel interior surface.

3. The handle mounting arrangement as set forth in claim 1 wherein said clip having a double-L shape in cross section comprising a base panel, a head panel upstanding from one end of said base panel and a foot panel depending from an opposite end of said base panel, said head panel defining a first predetermined obtuse angle with said base panel and said foot panel defining a second predetermined obtuse angle with said base panel.

4. The handle mounting arrangement as set forth in claim 3 wherein said head panel defining a first predetermined obtuse angle of the order of 104 degrees with said base panel and said foot panel defining a second predetermined obtuse angle of the order of 110 degrees with said base panel.

5. The handle mounting arrangement as set forth in claim 4 wherein said nut having a transverse bearing surface whereby upon said nut being initially tightened said nut bearing surface defining a predetermined acute angle with said head panel.

6. The handle attaching arrangement as set forth in claim 5 wherein upon said nut being fully tightened it sandwiches said head panel in a flush contact manner between said nut bearing surface and a free end of said stem resulting in downward movement of said foot panel into its locked position whereby it contacts both said panel interior surface and said housing terminal flange.

7. The handle attaching arrangement as set forth in claim 1 wherein said aperture defined by a of flanged border offset inwardly from said panel exterior surface such that with said housing mounted in said panel aperture said housing terminal flange is substantially flush with the exterior surface thereof.

8. The handle attaching arrangement as set forth in claim 1 wherein said notch means in the form of a plurality of tabs extending outboard from an undersurface of said rib, each said tab defining with said rib offset face a generally right-angled notch.

9. The handle attaching arrangement as set forth in claim 1 wherein said ramp means in the form of a plurality of triangular-shaped fillets each providing an angled edge ramp portion, whereby said fillet angled edge ramp portions are located in a common plane defining a ramp providing predetermined travel of said clip from its initial pre-installed position to its locked position.

10. The handle attaching arrangement as set forth in claim 2 wherein:

said support means comprising an elongated stem having one end integrally joined to said housing central body portion and its opposite free end provided with an axial bore, said threaded shank having one end anchored in said bore and its free end projecting inboard from said housing;

said housing having a pair of vertically disposed fillets integrally molded on either side of said ramp means, said fillets being longitudinally spaced a predetermined dimension slightly greater than the width of said clip base and foot panels whereby said clip is positioned between said fillets for guided travel on said ramp means into its locked position.

11. The handle attaching arrangement as set forth in claim 10 wherein said stem having a pair of integral horizontally disposed gusset plates integrally formed therewith and extending in a co-planar manner from either side of said stem;

said clip head panel having a predetermined width less than the width of said base panel whereby a pair of mirror image, parallel, outer fingers are lanced therefrom, said pair of outer fingers are bent an acute angle such that in said pre-assembled mode said outer fingers are resiliently biased into gripping contact with an associated inboard edge of an associated one of said gusset plates, said outer fingers operative to maintain said clip in contact with said ramp means during movement of said clip from its pre-installed position to its housing locked position.

* * * * *